US010330285B2

(12) United States Patent
Son et al.

(10) Patent No.: US 10,330,285 B2
(45) Date of Patent: Jun. 25, 2019

(54) LAMP FOR VEHICLE

(71) Applicant: SL Corporation, Daegu (KR)

(72) Inventors: Woo Yeong Son, Gyeonsangbuk-do (KR); Sun Kyoung Park, Gyeonsangbuk-do (KR)

(73) Assignee: SL Corporation, Daegu (KR)

( * ) Notice: Subject to any disclaimer, the term of this patent is extended or adjusted under 35 U.S.C. 154(b) by 23 days.

(21) Appl. No.: 15/673,532

(22) Filed: Aug. 10, 2017

(65) Prior Publication Data

US 2018/0112853 A1 Apr. 26, 2018

(30) Foreign Application Priority Data

Oct. 25, 2016 (KR) ..... 10-2016-0139409

(51) Int. Cl.
*F21V 13/04* (2006.01)
*F21V 29/74* (2015.01)
(Continued)

(52) U.S. Cl.
CPC ..... *F21V 13/04* (2013.01); *F21S 41/148* (2018.01); *F21S 41/151* (2018.01); *F21S 41/19* (2018.01);
(Continued)

(58) Field of Classification Search
CPC . F21V 13/04; F21V 29/74; F21V 5/04; F21V 7/0083; F21S 41/148; F21S 41/19;
(Continued)

(56) References Cited

U.S. PATENT DOCUMENTS 7,156,544 B2 1/2007 Ishida
8,851,723 B2 * 10/2014 Peck ..... B60Q 1/06 362/516
(Continued)

FOREIGN PATENT DOCUMENTS

CN 105276484 A 1/2016
DE 10 2008 010 028 A1 8/2009
(Continued)

OTHER PUBLICATIONS

Office Action dated Jul. 31, 2018 in corresponding Korean Application No. KR 10-2016-0139409.
(Continued)

*Primary Examiner* — Alan B Cariaso
(74) *Attorney, Agent, or Firm* — Mintz Levin Cohn Ferris Glovsky and Popeo, P.C.; Kongsik Kim; Carolina Säve

(57) ABSTRACT

A vehicle lamp is provided that includes a lamp unit and a shield unit that shields light from the lamp unit. A lens unit is disposed in front of the shield unit and the lamp unit is mounted on a heat radiation unit. The lamp unit includes a first and second lamp unit disposed on an upper and lower side, respectively. The first lamp unit includes a first light source section having spaced apart light sources and a first reflection section having reflectors reflecting light from each light source in a forward direction. The second lamp unit includes a second light source section having spaced apart light sources and a second reflection section having reflectors reflecting light from each light source in a forward direction. Each of the first and second light source sections includes a central light source and side light sources on sides of the central light source.

9 Claims, 16 Drawing Sheets

(51) Int. Cl.

| | |
|---|---|
| ***F21V 5/04*** | (2006.01) |
| ***F21V 7/00*** | (2006.01) |
| ***F21S 45/47*** | (2018.01) |
| ***F21S 41/19*** | (2018.01) |
| ***F21S 41/29*** | (2018.01) |
| ***F21S 41/255*** | (2018.01) |
| ***F21S 41/39*** | (2018.01) |
| ***F21S 41/40*** | (2018.01) |
| ***F21S 41/47*** | (2018.01) |
| ***F21S 41/663*** | (2018.01) |
| ***F21S 41/148*** | (2018.01) |
| ***F21S 41/151*** | (2018.01) |
| *F21Y 115/10* | (2016.01) |
| *F21W 102/13* | (2018.01) |

(52) U.S. Cl.
CPC ..... *F21S 41/255* (2018.01); *F21S 41/295* (2018.01); *F21S 41/39* (2018.01); *F21S 41/40* (2018.01); *F21S 41/47* (2018.01); *F21S 41/663* (2018.01); *F21S 45/47* (2018.01); *F21V 5/04* (2013.01); *F21V 7/0083* (2013.01); *F21V 29/74* (2015.01); *F21W 2102/13* (2018.01); *F21Y 2115/10* (2016.08)

(58) Field of Classification Search
CPC ..... F21S 41/295; F21S 41/40; F21S 41/47; F21S 41/663; F21S 41/255; F21S 41/151; F21S 41/39; F21S 45/47; F21W 2102/13
See application file for complete search history.

(56) References Cited

U.S. PATENT DOCUMENTS

| | | | | |
|---|---|---|---|---|
| 9,108,563 | B2 | 8/2015 | Tanaka et al. | |
| 2005/0219856 | A1* | 10/2005 | Tatsukawa | F21S 41/155 362/507 |
| 2009/0073712 | A1* | 3/2009 | Yamamura | F21S 41/147 362/519 |
| 2009/0080211 | A1* | 3/2009 | Yasuda | F21S 41/147 362/547 |
| 2010/0244649 | A1* | 9/2010 | Inaba | F21K 9/00 313/46 |
| 2012/0039083 | A1 | 2/2012 | Meyrenaud | |
| 2012/0155101 | A1* | 6/2012 | Matsumoto | B60Q 1/0094 362/487 |
| 2013/0188380 | A1* | 7/2013 | Sekiguchi | F21V 13/12 362/516 |
| 2013/0215632 | A1* | 8/2013 | Jackl | F21S 41/192 362/514 |
| 2014/0313760 | A1 | 10/2014 | Yagi | |

FOREIGN PATENT DOCUMENTS

| | | | |
|---|---|---|---|
| DE | 10 2014 226 881 | A1 | 6/2016 |
| KR | 10-1486817 | B1 | 1/2015 |
| KR | 10-2015-0068141 | A | 6/2015 |

OTHER PUBLICATIONS

Office Action dated Sep. 5, 2018 in corresponding German Application No. 10 2017 216 731.9.

* cited by examiner

LAMP FOR VEHICLE

CROSS-REFERENCE TO RELATED APPLICATION(S)

This application claims priority from Korean Patent Application No. 10-2016-0139409 filed on Oct. 25, 2016 in the Korean Intellectual Property Office, the disclosure of which is incorporated herein by reference in its entirety.

BACKGROUND

1. Field of the Invention

The present invention relates to a lamp for a vehicle, and more particularly, to a vehicle lamp that reduces the configuration or cost required for heat radiation, while allowing generation of light with sufficient brightness.

2. Description of the Related Art

In general, a vehicle includes various lamps which have a lighting function for detecting an object located in the vicinity of a vehicle when driving at night or during low light conditions, and a signal function for informing a surrounding vehicle or a pedestrian of the traveling state of the vehicle. For example, a headlamp, a fog lamp, and the like are used to provide the lighting function. A turn signal lamp, a tail lamp, a brake lamp, a side marker, and the like are used to provide the function of a signal. Further, these lamps for vehicles are regulated by laws and regulations concerning installation criteria and standards to fully exhibit each function.

Meanwhile, recently, a semiconductor light-emitting element such as an LED has been used as a light source of a lamp for a vehicle. Since the LED has a color temperature of about 5500 K close to sunlight, the LED gives less fatigue to the eyes of a person, enhances the degree of freedom of the lamp design by minimizing the size, and is also more economical due to a semi-permanent service life. Further, attempts have been made to overcome the conventional complicated lamp configuration and an increase in operation step by introducing the LED, and there has been a tendency to extend the service life of the lamp due to the characteristics of the LED itself, and to overcome spatial problems due to the small size.

In general, a light source of a vehicle lamp includes a plurality of light-emitting elements disposed adjacent to each other to generate light of brightness suitable for each function, and in this case, since high-temperature heat is generated together with generation of light, a heat radiation device for rapidly releasing heat is required. However, when a plurality of light-emitting elements are adjacent to each other, heat generated from each light-emitting element concentrates and a substantial amount of heat radiation performance may be required. To enhance the heat radiation performance, it is necessary to add a heat radiation device or increase the size of the heat radiation device, resulting in an increase in the configuration and cost. Therefore, there is a demand for a scheme capable of reducing the configuration and cost required for heat radiation, while allowing generation of light with brightness suitable for the function of a vehicle lamp.

SUMMARY

An aspect of the present invention provides a lamp for a vehicle which disperses the generated heat by separately disposing a plurality of light sources for generating light from each other, thereby making it possible to reduce the configuration and cost required for heat radiation. The aspects of the present invention are not limited to the aspect mentioned above, and another aspect which is not mentioned can be clearly understood by those skilled in the art from the description below.

A lamp for a vehicle according to an exemplary embodiment of the present invention may include at least one lamp unit; a shield unit which shields a part of light generated from the at least one lamp unit; a lens unit disposed in front of the shield unit; and a heat radiation unit on which the at least one lamp unit is mounted. The at least one lamp unit may include a first lamp unit and a second lamp unit disposed on an upper side and a lower side based on an optical axis of the lens unit, respectively. The first lamp unit may include a first light source section that has a plurality of light sources spaced apart from each other in a predetermined direction; and a first reflection section that has a plurality of reflectors configured to reflect light generated from each of the plurality of light sources in a forward direction. The second lamp unit may include a second light source section that has a plurality of light sources spaced apart from each other in a predetermined direction; and a second reflection section that has a plurality of reflectors configured to reflect light generated from each of the plurality of light sources in a forward direction. Each of the first light source section and the second light source section may include a central light source, and a plurality of side light sources spaced apart from each other on both sides of the central light source.

According to the lamp for vehicle of the present invention as described above, the following one or more effects are provided. By disposing the plurality of light sources including at least one light-emitting element to be separated from each other, the configuration required for heat radiation is reduced, while enabling generation of light with sufficient brightness, and thus, a decrease in overall cost is realized.

The effects of the present invention are not limited to the effects mentioned above, and another effect that has not been mentioned can be clearly understood by those skilled in the art from the description of the scope of claims.

BRIEF DESCRIPTION OF THE DRAWINGS

The above and other aspects and features of the present invention will become more apparent by describing in detail exemplary embodiments thereof with reference to the attached drawings, in which.

DETAILED DESCRIPTION

Figure 1:
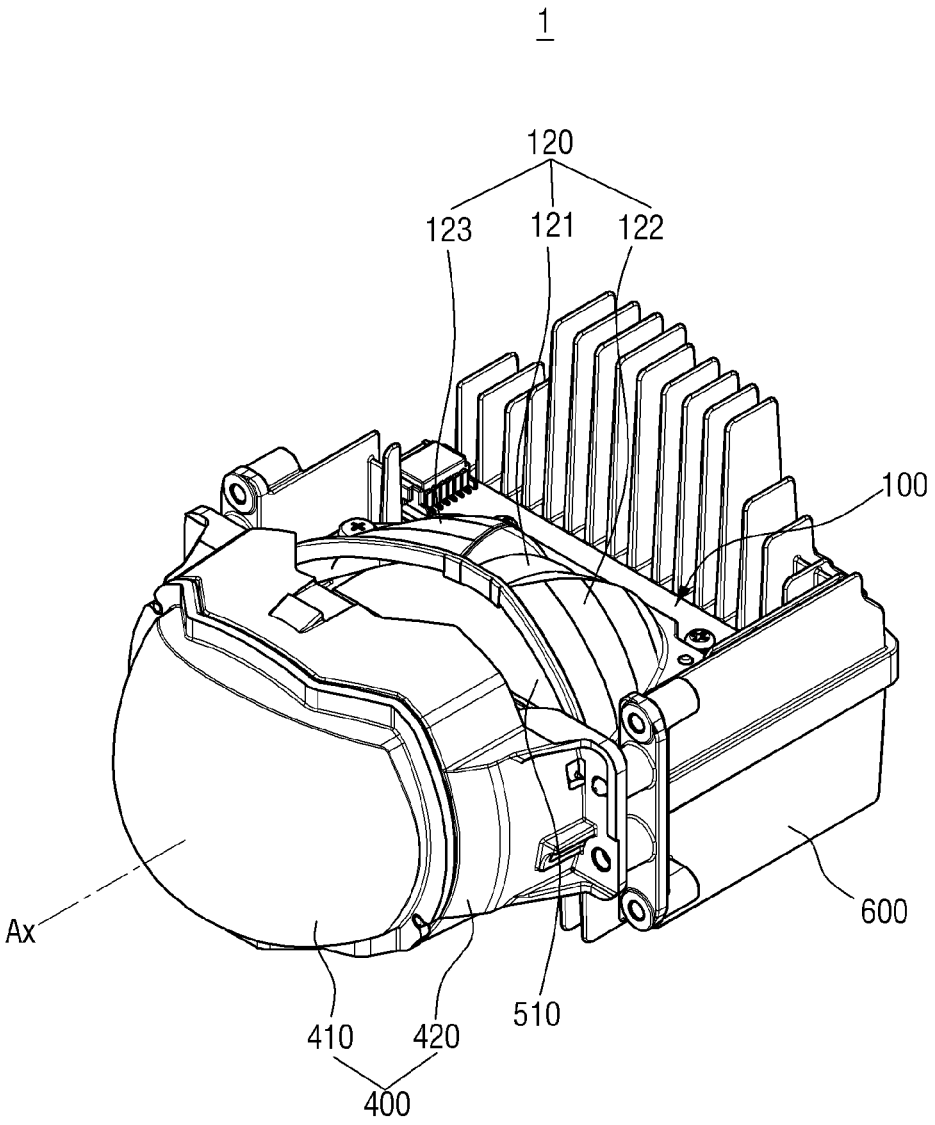
FIGS. 1 and 2 are perspective views illustrating a lamp for a vehicle according to an exemplary embodiment of the present invention.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Advantages and features of the present invention and methods of achieving the same will become apparent with reference to the exemplary embodiments described in detail below in conjunction with the accompanying drawings. However, the present invention is not limited to the exemplary embodiments disclosed below, but may be provided in various different forms. The present exemplary embodiments are merely provided to make the disclosure of the present invention complete and to fully inform the category of the invention to a person having ordinary knowledge in the technical field to which the present invention pertains, and the present invention is only defined by the scope of the claims. The same reference numerals refer to the same constituent elements throughout the specification.

Thus, in some exemplary embodiments, well-known process steps, well-known structures and well-known techniques will not be specifically described in order to avoid ambiguous interpretation of the present invention. The terms used in the present specification are for the purpose of illustrating the examples and do not limit the present invention.

The exemplary embodiments described herein will be also described with reference to cross-sectional and/or schematic views, which are ideal exemplary view of the present invention. Therefore, the form of the exemplary view may be modified by manufacturing technique and/or tolerance and the like. Therefore, the exemplary embodiments of the present invention also include a change in the form generated according to the manufacturing process, without being limited to the illustrated specific form. Further, in each drawing illustrated in the present invention, the respective constituent elements may be illustrated by being slightly enlarged or reduced in view of the convenience of explanation. The same reference numerals refer to the same elements throughout the specification.

Hereinafter, the present invention will be described with reference to drawings for explaining a lamp for vehicle according to an exemplary embodiment of the present invention.

Figure 2:
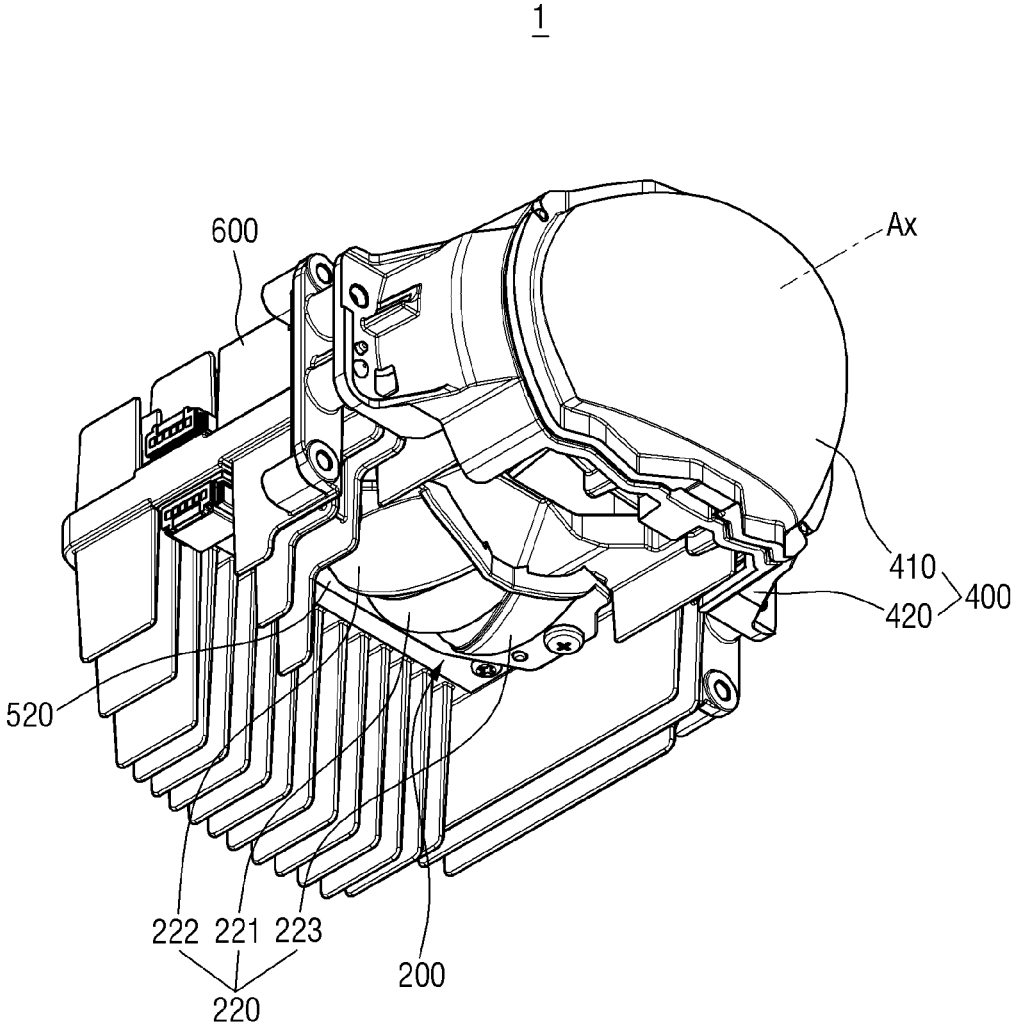
Figure 3:
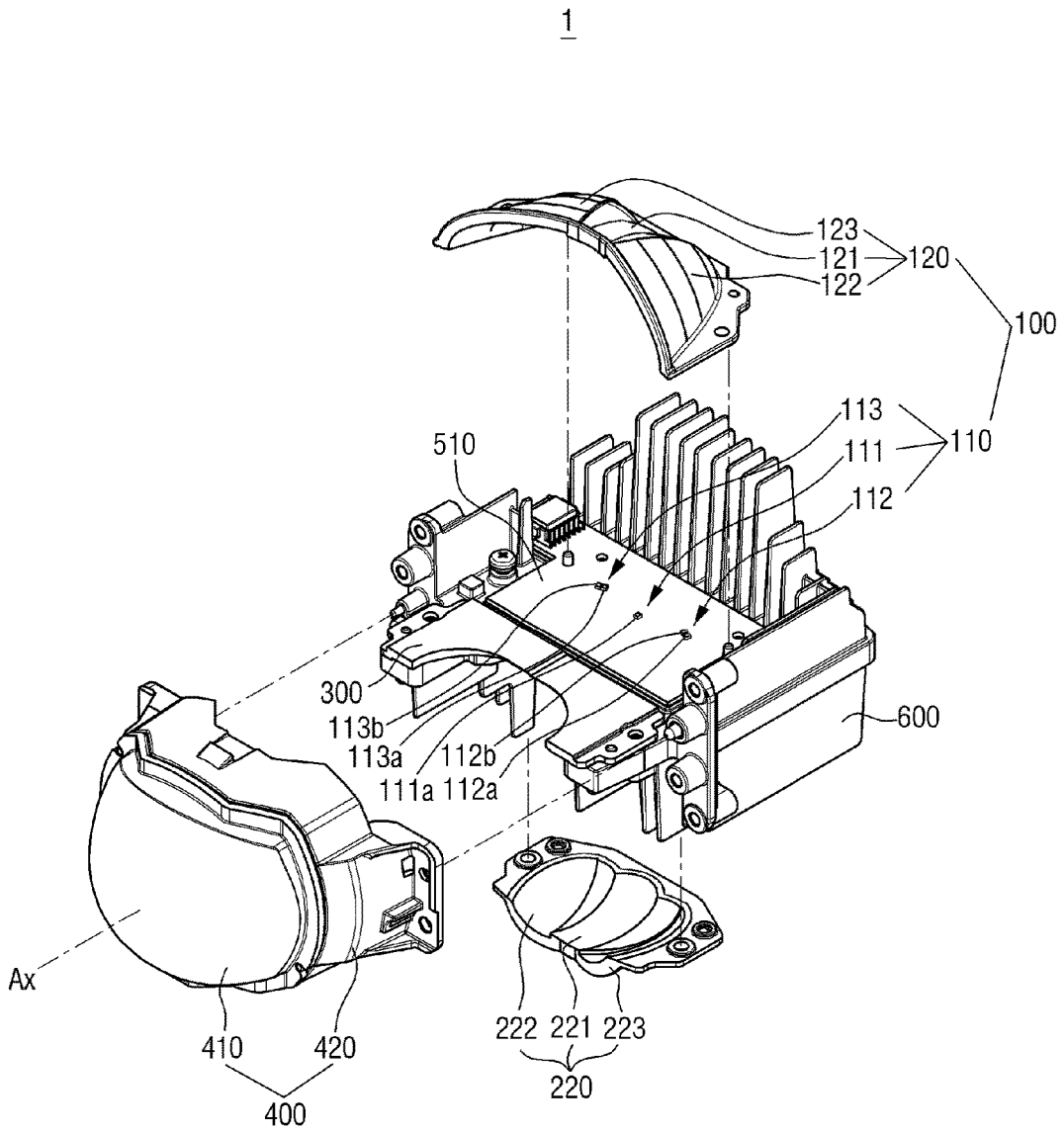
FIGS. 3 and 4 are detailed views illustrating a lamp for a vehicle according to an exemplary embodiment of the present invention.
Figure 4:
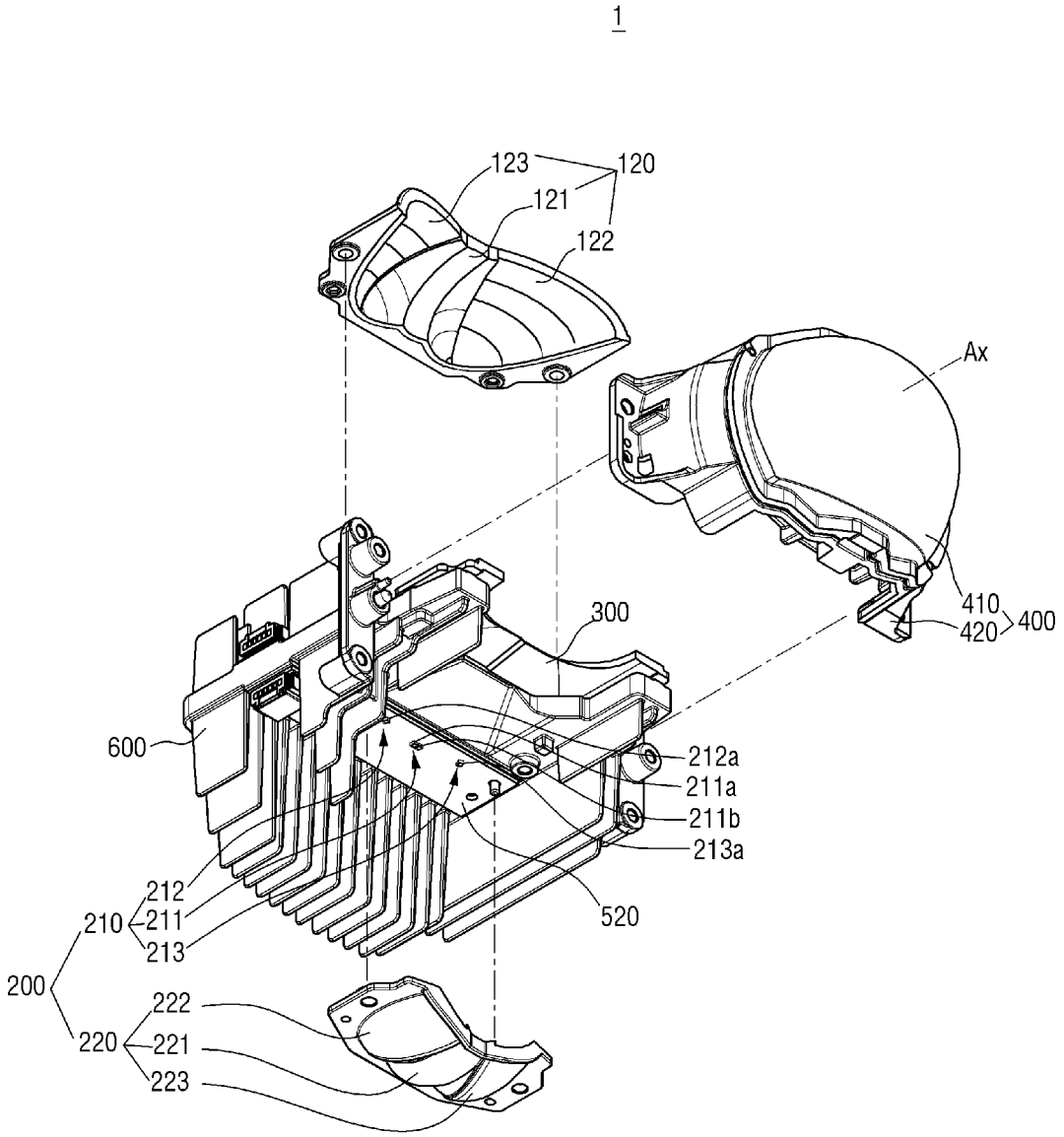
Figure 5:
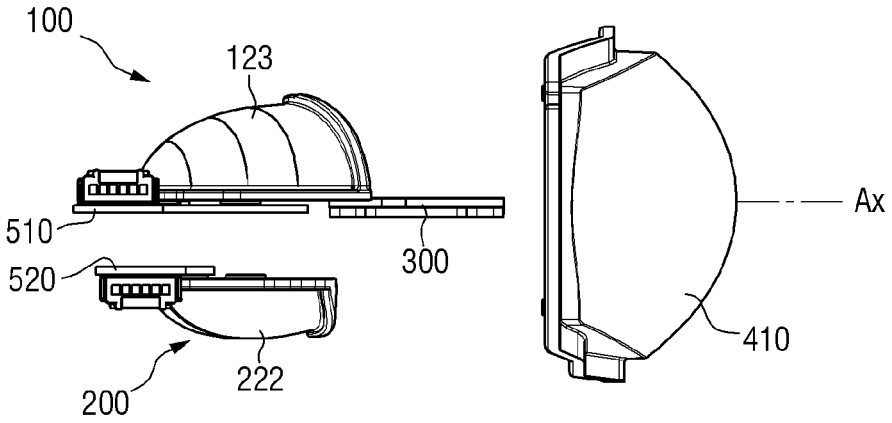
FIG. 5 is a side view illustrating a lamp for a vehicle according to an exemplary embodiment of the present invention.

FIGS. 1 and 2 are perspective views illustrating a lamp for a vehicle according to an exemplary embodiment of the present invention, FIGS. 3 and 4 are exploded perspective views illustrating a lamp for a vehicle according to an exemplary embodiment of the present invention, and FIG. 5 is a side view illustrating a lamp for a vehicle according to an exemplary embodiment of the present invention. Referring to FIGS. 1 through 5, a lamp for a vehicle 1 according to an exemplary embodiment of the present invention may include a first lamp unit 100, a second lamp unit 200, a shield unit 300, and a lens unit 400.

Figure 6:
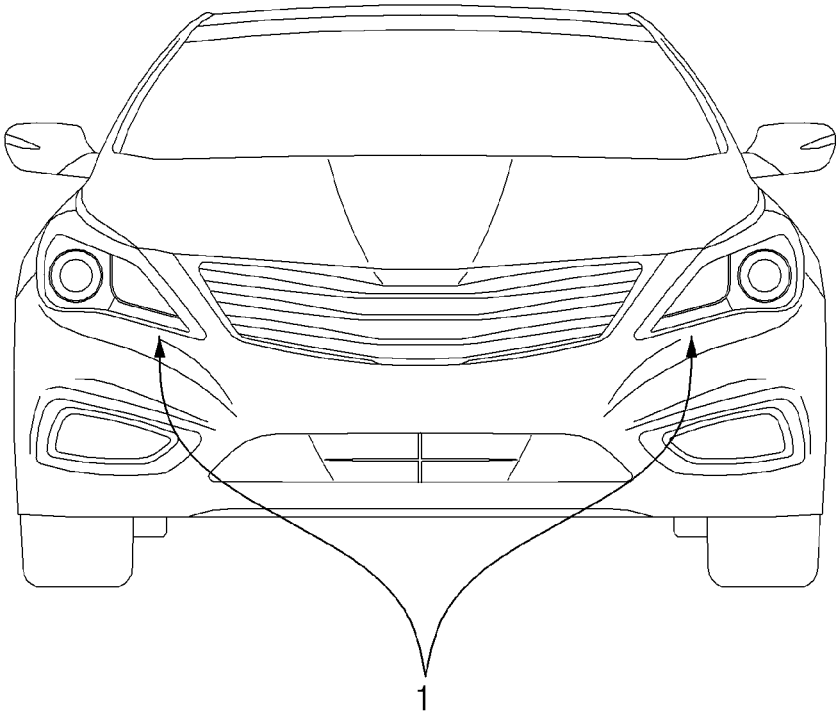
FIG. 6 is a schematic view illustrating a vehicle in which a lamp for vehicle according to an exemplary embodiment of the present invention is installed.

In the exemplary embodiment of the present invention, as illustrated in FIG. 6, the description will be given of the lamp for a vehicle 1 used as a head lamp which is installed on both sides of the front of the vehicle to secure the front visual field of the vehicle when the vehicle is being driven in a dark place or at night (e.g., poor lighting conditions). However, the present invention is not limited to this case, and the lamp for vehicle 1 of the present invention may also be used as various lamps installed in the vehicle, such as a daytime traveling lamp, a fog lamp, a tail lamp, a brake lamp, a turn signal lamp, a position lamp, and a backup lamp.

Further, in the exemplary embodiment of the present invention, the lamp for a vehicle 1 (e.g., a vehicle lamp) may form various beam patterns in accordance with the traveling environment of the vehicle, and as an example, the lamp may form various beam patterns, such as a low beam pattern formed to have a predetermined cut-off line to prevent an occurrence of glare to a driver of a front vehicle, or a high beam pattern for securing a long-distance visual field.

In the exemplary embodiment of the present invention, the description will be given of when forming the low beam pattern, the first lamp unit 100 is turned on, and when forming the high beam pattern, the second lamp unit 200 is turned on together with the first lamp unit 100 as an example. The first lamp unit 100 and the second lamp unit 200 may be disposed in different directions based on the optical axis Ax of the lens unit 400. In addition, the description will be given of when the first lamp unit 100 is disposed on the upper side of the optical axis Ax, and the second lamp unit 200 is disposed on the lower side of the optical axis Ax, as an example, but the prevent invention is not limited thereto.

Figure 7:
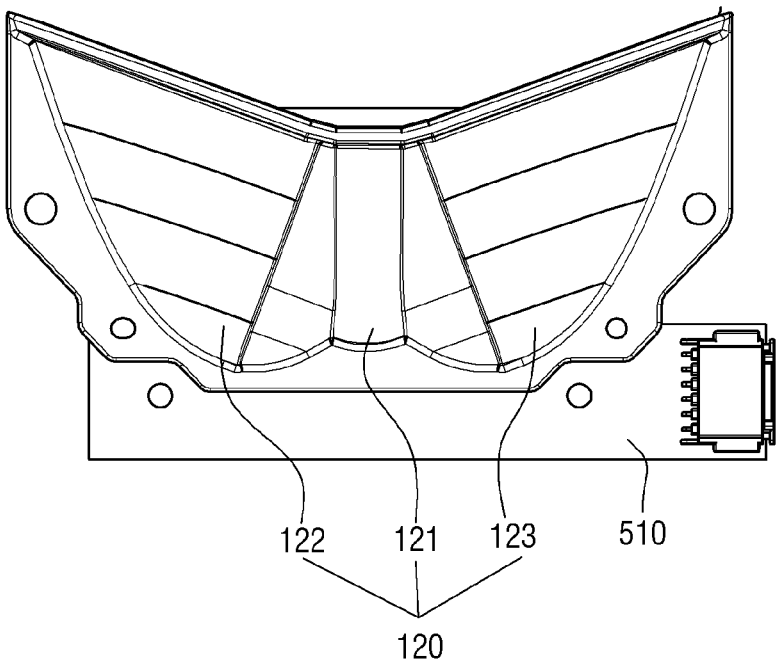
FIG. 7 is a plan view illustrating a first lamp unit according to an exemplary embodiment of the present invention.
Figure 8:
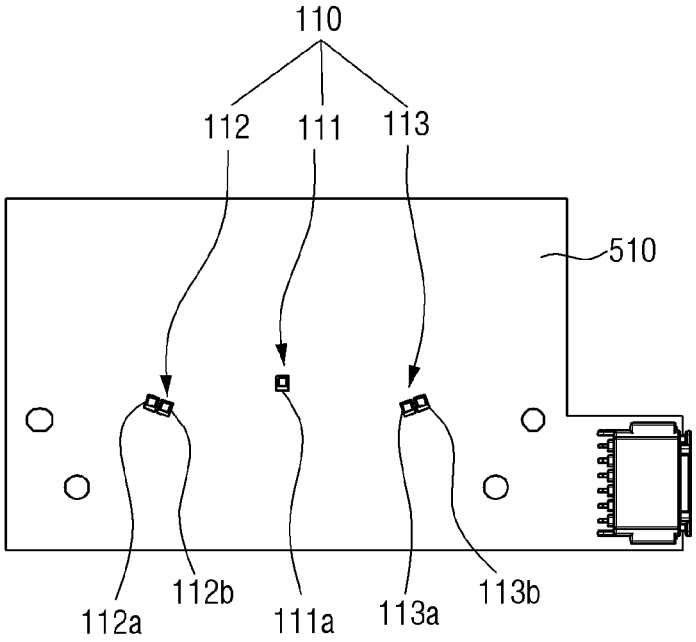
FIG. 8 is a plan view illustrating a first light source section according to an exemplary embodiment of the present invention.

FIG. 7 is a plan view illustrating a first lamp unit according to an exemplary embodiment of the present invention, and FIG. 8 is a plan view illustrating a first light source section according to an exemplary embodiment of the present invention. Referring to FIGS. 7 and 8, the first lamp unit 100 may include a first light source section 110 and a first reflection section 120. The first light source section 110 may include a plurality of light sources 111, 112, and 113 spaced apart from each other at predetermined intervals, and in the exemplary embodiment of the present invention, the plurality of light sources 111, 112, and 113 may be spaced apart from each other in a lateral direction.

Hereinafter, in the exemplary embodiment of the present invention, the description will be given of the lateral direction perpendicular to the optical axis Ax of the lens unit 400 and a horizontal direction. In particular, the description will be given of a plurality of light sources 111, 112, and 113 installed on the upper surface of a substrate 510 to generate light in the upward direction as an example. Various components for power supply and control of the plurality of light sources 111, 112, and 113, as well as the plurality of light sources 111, 112, and 113 may be installed on the substrate 510.

Each of the plurality of light sources 111, 112, and 113 may include at least one light-emitting element, and in the exemplary embodiment of the present invention, the description will be given of the LED used as a light-emitting element, but various types of semiconductor light-emitting elements may be used, without being limited thereto. Particularly, the substrate 510 may be attached to a heat radiation unit 600 such as a heat sink. Thus, when the LED is used as the light-emitting element of the plurality of light sources 111, 112, and 113, sudden performance degradation occurs at the time of the temperature increase due to the high-temperature heat generated together at the time of generation of light.

The plurality of light sources 111, 112, and 113 may include a central light source 111, and a plurality of side light sources 112 and 113 spaced apart from each other on both sides of the central light source 111. Light generated from the central light source 11 forms a high illuminance region of a low beam pattern, and light from the plurality of side light sources 112 and 113 may form a spread region of a low beam pattern. In the exemplary embodiment of the present invention, the description will be given of the number of the light-emitting elements 112*a*, 112*b*, 113*a*, and 113*b* of the plurality of side light sources 112 and 113 being greater than the number of the light-emitting elements 111*a* of the central light source 111 as an example. This is merely an example for aiding the understanding of the present invention, and the number of the light-emitting elements included in the central light source 111 and the plurality of side light sources 112 and 113 may be varied based on the illuminance characteristics of the low beam pattern.

Further, the number of the light-emitting elements 112*a*, 112*b*, 113*a*, and 113*b* included in the plurality of side light sources 112 and 113 is preferably the same as each other. Accordingly, the spread region of the low beam pattern may have uniform illuminance One of the central light source 111 or the plurality of side light sources 112 and 113 may be disposed in front of the other to disperse heat generated from the central light source 111 and the plurality of side light sources 112 and 113, thereby improving the heat radiation performance. In the exemplary embodiment of the present invention, when the central light source 111 is disposed in front of the plurality of side light sources 112 and 113 has been described as an example, but the present invention is not limited thereto. The central light source 111 may be disposed behind the side light sources 112 and 113 in accordance with a lamp unit 200 to be described later, and the detailed description will be given later.

The first reflection section 120 may be configured to reflect light generated from the first light source section 110 in the forward direction, and in the exemplary embodiment of the present invention, since light may be generated in the upward direction from the first reflection section 120, the first reflection section 120 may be formed with the surface from the lower side to the front side being open to reflect the light generated from the first light source portion 110 in the forward direction, and a reflective surface made of a material having a high reflectance such as aluminum or chromium may be formed on the surface facing the first light source section 110.

In addition, reflection of light in the forward direction indicates reflection of the light to the lens unit 400 side to which the light from the lamp of the present invention is irradiated, and the actual direction indicated by the front may be different, based on the direction, the position, and the like in which the lamp of the present invention is installed. Further, the front does not refer to any one direction, but may include all directions of incidence with respect to the incident surface of the lens unit 400 at various angles.

The first reflection section 120 may include a plurality of reflectors 121, 122, and 123 configured to reflect light generated from each of the plurality of light sources 111, 112, and 113 in the forward direction. The plurality of reflectors 121, 122, and 123 may include a central reflector 121, and a plurality of side reflectors 122 and 123 disposed on both sides of and the central reflector 121, like the plurality of light sources 111, 112, and 113 mentioned above. In the exemplary embodiment of the present invention, the description will be given of when the plurality of reflectors 121, 122, and 123 are formed integrally through an injection process or the like as an example, but the present invention is not limited thereto, and a plurality of reflectors 121, 122, and 123 may be separately formed and joined together.

Furthermore, both sides of the front end of the first reflection section 120 may be distant from the optical axis Ax of the lens unit 400 from the front end of the central reflector 121 toward the plurality of side reflectors 122 and 123, and may be disposed to face the lens unit 400 and thus, the front end of the first reflection section 120 may have a generally "V" shape as a whole. Accordingly, the light generated from the plurality of light sources 111, 112, and 113 may expand to thus improve the spread characteristics of the low beam pattern. Further, the first reflection section 120 may be formed such that the lateral sizes of the plurality of side reflectors 122 and 123 are greater than the lateral size of the central reflector 121 to thus improve the spread characteristics of the low beam pattern.

Figure 9:
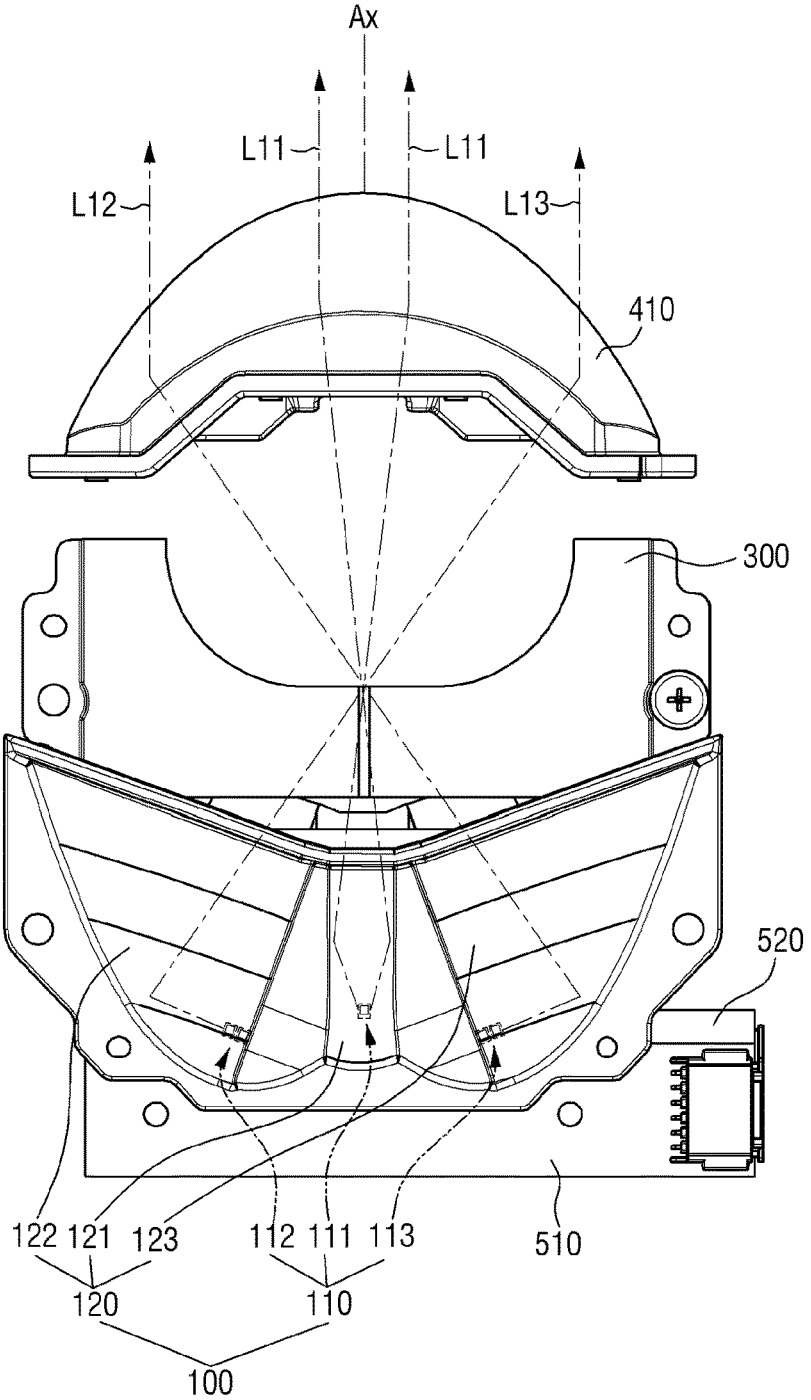
FIG. 9 is a schematic view illustrating an optical path of a first lamp unit according to an exemplary embodiment of the present invention.

Hereinafter, in the exemplary embodiment of the present invention, the lateral size is perpendicular to the optical axis Ax of the lens unit 400, and may be understood as the width between both side ends of the reflective surface of the reflector in the horizontal direction. FIG. 9 is a schematic view illustrating the optical path of the first lamp unit according to the exemplary embodiment of the present invention, and FIG. 10 is a schematic view illustrating a low beam pattern formed by the first lamp unit according to the exemplary embodiment of the present invention.

Figure 10:
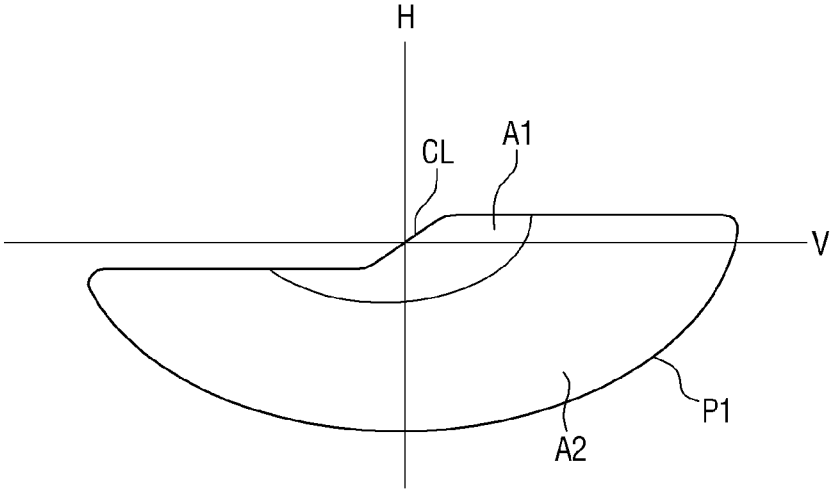
FIG. 10 is a schematic view illustrating a low beam pattern formed by the first lamp unit according to the exemplary embodiment of the present invention.

Referring to FIGS. 9 and 10, in the first lamp unit 100, light L11 generated from the central light source 111 may be reflected by the central reflector 121 to form high illuminance region A1 of the low beam pattern P1, and light L12 and L13 generated from the plurality of side light sources 112 and 113 may be reflected by the plurality of side reflectors 122 and 123 to form a spread region A2 of the low beam pattern P1.

When the number of light-emitting elements included in the side light sources 112 and 113 is different, since illuminance between different regions of the spread area A2 may be different from each other, the plurality of side light sources 112 and 113 may include the same number of light-emitting elements. Meanwhile, although the upper end of the low beam pattern P1 of FIG. 10 has a predetermined cut-off line CL, the cut-off line CL may be formed by a shield unit 300 to be described later.

Figure 11:
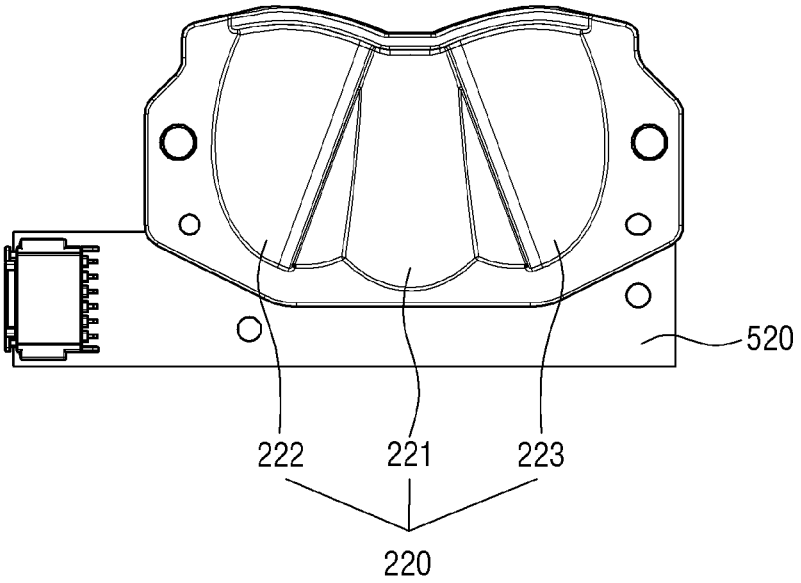
FIG. 11 is a plan view illustrating a second lamp unit according to an exemplary embodiment of the present invention.
Figure 12:
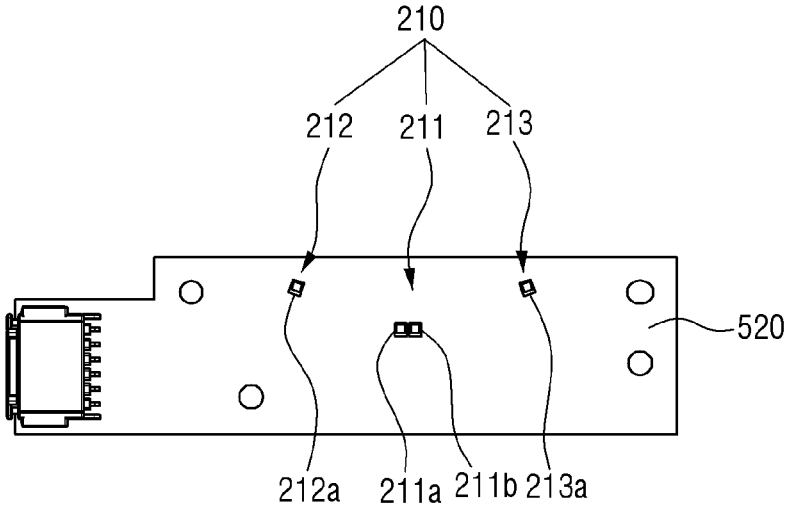
FIG. 12 is a plan view illustrating a second light source section according to an exemplary embodiment of the present invention.

FIG. 11 is a plan view illustrating a second lamp unit according to an exemplary embodiment of the present invention, and FIG. 12 is a plan view illustrating a second light source section according to an example of the present invention. Referring to FIGS. 11 and 12, a second lamp unit 200 may include a second light source section 210 and a second reflection section 220. The second lamp unit 200 may be configured to form a high-beam pattern, by forming a long-distance visual field pattern for securing a long-distance visual field, in addition to the low beam pattern formed by the first lamp unit 100.

The second light source section 210 may include a plurality of light sources 211, 212, and 213 spaced apart from each other at a predetermined interval, and in an exemplary embodiment of the present invention, the description will be given of the plurality of light sources 211, 212, and 213 spaced apart from each other in the lateral direction, similarly to the above-described first light source section 110. Each of the plurality of light sources 211, 212, and 213 may include at least one light-emitting element, and the plurality of light sources 211, 212, and 213 may include a central light source 211, and plurality of side light sources 212 and 213 spaced apart from each other on both sides of the central light source 211.

In the exemplary embodiment of the present invention, the description will be given of light-emitting elements 211*a* and 211*b* of the central light source 211 of the second light source section 210 being greater than the number of the light-emitting elements 212*a* and 213*b* included in the plurality of side light sources 212 and 213 as an example. Accordingly, the high illuminance region of the long-distance visual field pattern may have sufficient illuminance, however, the invention is not limited to thereto, and the number of light-emitting elements included in the central light source 211 and the plurality of side light sources 212 and 213 may be varied in accordance with the illuminance characteristics of the long-distance visual field pattern.

The number of the light-emitting elements 212*a* and 213*a* included in the plurality of side light sources 212 and 213 is preferably the same to make the spread region of the long-distance visual field pattern have a more uniform brightness as a whole. Additionally, the plurality of light sources 211, 212, and 213 of the second light source section 210 may be installed on the lower surface of the substrate 520 mounted on the heat radiation unit 600 to generate light in the downward direction. The plurality of light sources 211, 212, and 213 may be configured to form a high beam pattern, together with the first lamp unit 100 described above.

In the exemplary embodiment of the present invention, although the case where the substrate 510 of the first lamp unit 100 and the substrate 520 of the second lamp unit 200 are provided, respectively, is described as an example, the first lamp unit 100 and the second lamp unit 200 may share one substrate, without being limited thereto. Meanwhile, similarly to the above-described first light source section 110, in the second light source section 210, one of the central light source 211 and the plurality of side light sources 212 and 213 may be disposed in front of the other to disperse the heat generated from the central light source 211 and the plurality of side light sources 212 and 213, thereby improving the heat radiation performance.

In the exemplary embodiment of the present invention, the description will be given of the plurality of side light sources 212 and 213 of the second light source section 210 disposed in front of the central light source 211 as an example. The plurality of side light sources 212 and 213 of the second light source section 210 may be disposed in front of the central light source 211 to not overlap the central light source 111 and the plurality of side light sources 112 and 113 of the first light source section 110 to disperse the heat. When the positions of the central light source 111 and the plurality of side light sources 112 and 113 of the first light source section 110 change, the positions of the central light source 211 and the plurality of side light sources 212 and 213 of the second light source section 210 may also change.

For example, unlike the above-described FIG. 8, when the central light source 111 of the first light source section 110 is disposed behind the plurality of side light sources 112 and 113, unlike FIG. 12, the central light source 211 of the second light source section 210 may be disposed in front of the plurality of side light sources 212 and 213. Meanwhile, the exemplary embodiment of the present invention illustrates the positional relation between the central light sources 111 and 211 of the first light source section 110 and the second light source section 210 opposite to the positional relation between the plurality of side light sources 112, 113, 212, and 213. However, the present invention is not limited thereto, and all the plurality of light sources 111, 112, and 113 of the first light source section 110 may be disposed in front of or behind the plurality of light sources 211, 212, and 213 of the second light source section 210.

Therefore, the central light source 111 of the first light source section 110 and the central light source 211 of the second light source section 210 may be separated from each other forward and backward, and the plurality of side light sources 112 and 113 of the light source section 110 and the plurality of side light sources 212 and 213 of the second light source section 210 may also be separated from each other forward and backward. Thus, since heat may be dispersed, the heat radiation performance may be improved.

Figure 13:
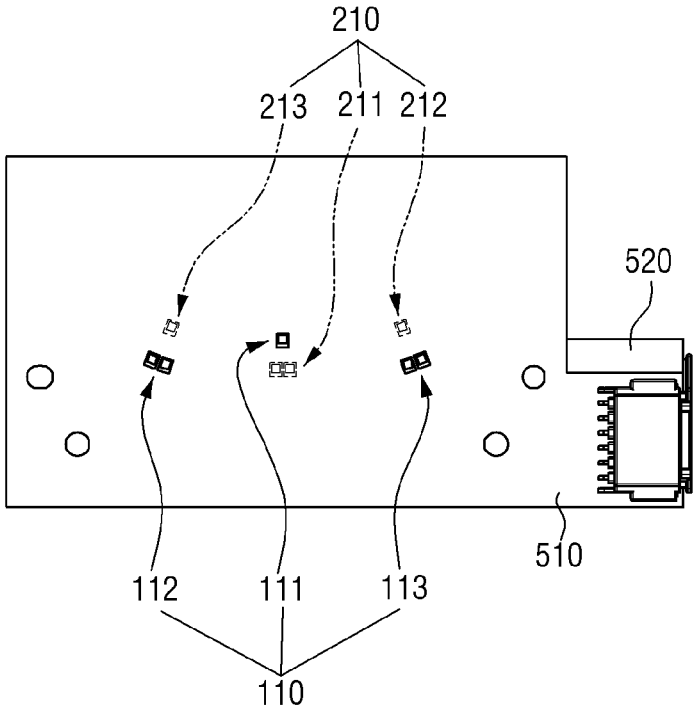
FIG. 13 is a schematic view illustrating a first light source section and a second light source section according to an exemplary embodiment of the present invention.

In other words, as illustrated in FIG. 13, when the central light source 111 and the plurality of side light sources 112 and 113 of the first light source section 110 are spaced apart from each other in the lateral direction, and the central light source 211 and the plurality of side light sources 212 and 213 of the second light source section 210 are spaced apart from each other in the lateral direction, the central light source 111 of the first light source section 110 and the central light source 211 of the second light source section 210 are spaced apart from each other forward and backward, and the plurality of side light sources 112 and 113 of the first light source section 110 and the plurality of side light sources 212 and 213 of the second light source section 210 are spaced from each other forward and backward, the heat generated from the first light source section 110 and the second light source section 120 may be dispersed and the required heat radiation performance may be degraded.

In other words, when the central light source 111 and the plurality of side light sources 112 and 113 of the first light source section 110 are not spaced apart from each other, and the central light sources 211 and the plurality of side light sources 212 and 213 of the second light source section 210 are not spaced apart from each other, and all the light sources are concentrically disposed at a specific point, the generated heat is also concentrated. Thus, it is necessary to use a heat sink as a heat radiation unit 600 and also an additional heat radiation device such as a cooling fan for sufficient heat radiation. However, in the exemplary embodiment of the present invention, since sufficient heat radiation performance may be exerted with only the heat sink as the heat radiation unit 600, the configuration and the cost thereof may be reduced.

Moreover, FIG. 13 is a view of the first light source 110 when viewed from the upper surface of the substrate 510 of the first lamp unit 100, and the dotted line of FIG. 13 may be understood as the second light source section 210 installed on a substrate 520 of the second lamp unit 200. When the first lamp unit 100 and the second lamp unit 200 are turned on to form a high beam pattern, the central light source 111 of the first light source section 110 and the plurality of side light sources 212 and 213 of the second light source section 210 may be configured to reinforce the high illuminance region of the high beam pattern, to thus improve the long-distance visual field.

The second reflection section 220 may be configured to reflect the light generated from the second light source section 210 in the forward direction. In the exemplary embodiment of the present invention, since the plurality of light source 211, 212, and 213 of the second light source section 210 may be disposed on the lower surface of the substrate 520 and light is generated in the downward direction, the second reflection section 220 may be formed with the surface from the upper side to the front side open, and a reflective surface made of a material having a high reflectance such as aluminum or chromium may be formed on the surface facing the plurality of light sources 211, 212, and 213. Therefore, the reflective surface of the second reflection section 220 may be disposed to face the reflective surface of the first reflection section 120.

The second reflection section 220 may include a plurality of reflectors 221, 222, and 223 which reflects light generated from each of the plurality of light sources 211, 212, and 213 to the lens unit 400. Similar to the plurality of light sources 211, 212, and 213, the plurality of reflectors 221, 222, and 223 may include a central reflector 221, and a plurality of side reflectors 222 and 223 disposed on both sides of the central reflector 221.

In addition, although the description will be given of the plurality of reflectors 221, 222, and 223 of the second reflection section 220 formed integrally through an injection process or the like as an example, the plurality of reflectors 221, 222, and 223 may be separately formed and joined to each other, without being limited thereto. The lateral sizes of the plurality of side reflectors 222 and 223 of the second reflection section 220 may be greater than the lateral size of the central reflector 221 to improve the spread characteristics.

Further, both sides of the front end of the second reflection section 220 may have a shape which retracts toward the optical axis Ax of the lens unit 400 to improve the focusing properties of light generated from the second lamp unit 200. In other words, the first lamp unit 100 may have a shape in which both sides of the front end of the first reflection section 120 spread to improve the spread characteristics, whereas the second lamp unit 200 may have a shape in which both sides of the front end of the second reflection section 220 retract to allow light to be focused for securing a long-distance visual field.

Figure 14:
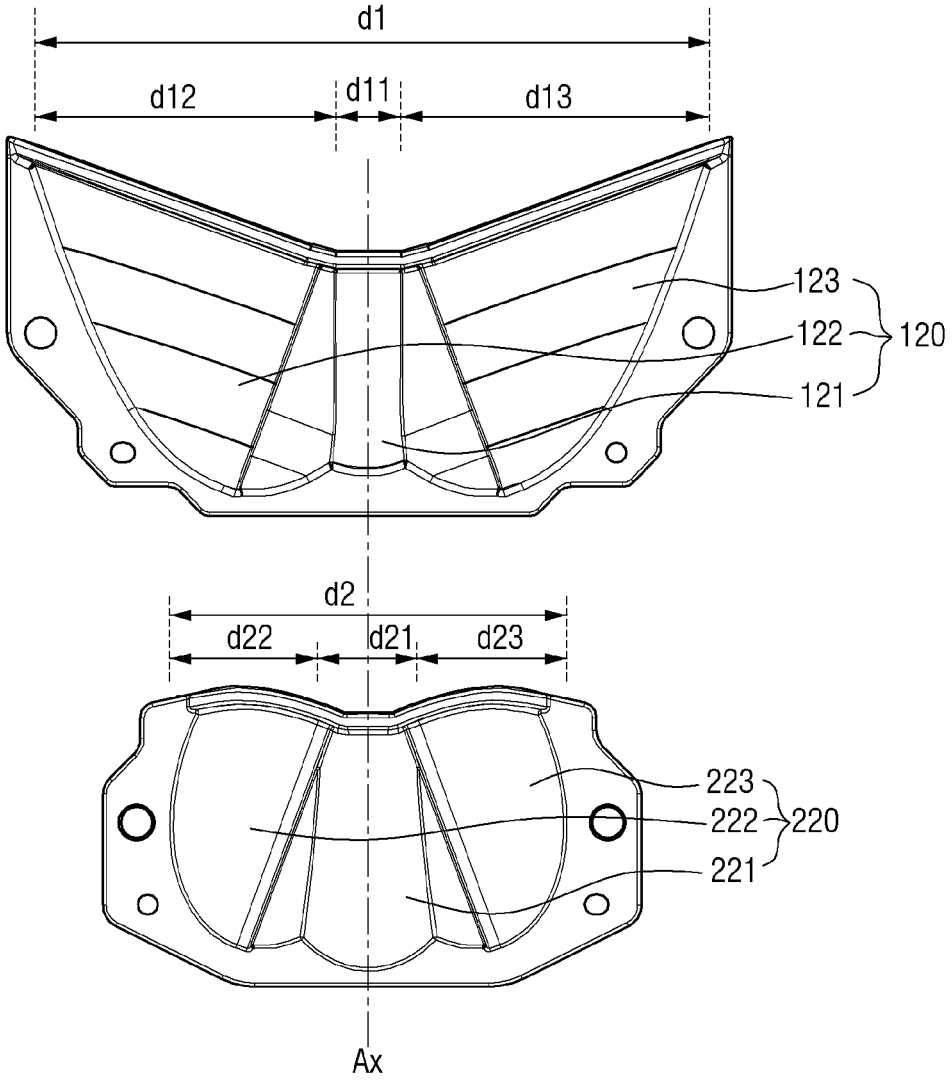
FIG. 14 is a schematic view illustrating a first reflection section and a second reflection section according to the exemplary embodiment of the present invention.

Meanwhile, as illustrated in FIG. 14, a lateral size d2 of the second reflection section 220 may be formed to be smaller than a lateral size d1 of the first reflection section 120 to improve the spread characteristics since the first lamp unit 100 forms the low beam pattern. Further, it may be possible to determine that a lateral size d21 of the central reflector 221 of the second reflection section 220 is greater than the lateral size d11 of the central reflector 121 of the first reflection section 120 since the number of the light-emitting elements 211*a* and 211*b* included in the central light source 211 of the second light source section 210 is greater than the number of the light-emitting elements 111*a* included in the central light source 111 of the first light source section 110.

When the numbers of the light-emitting elements included in the central light source 111 of the first light source section 110 and the central light source 211 of the second light source section 210 differ, the lateral size d11 of the central reflector 121 of the first reflection section 120 and the lateral size d21 of the central reflector 221 of the second reflection section 220 may also differ. Additionally, in the first reflection section 120 and the second reflection section 220, it may be possible to determine that the sizes d12, d13, d22, and d23 of the plurality of side reflectors 112, 113, 222, and 223 are greater than the lateral sizes d11 and d21 of the central reflectors 121 and 221 to improve the spread characteristics of the beam pattern formed by each of the lamp units 100 and 120.

Figure 15:
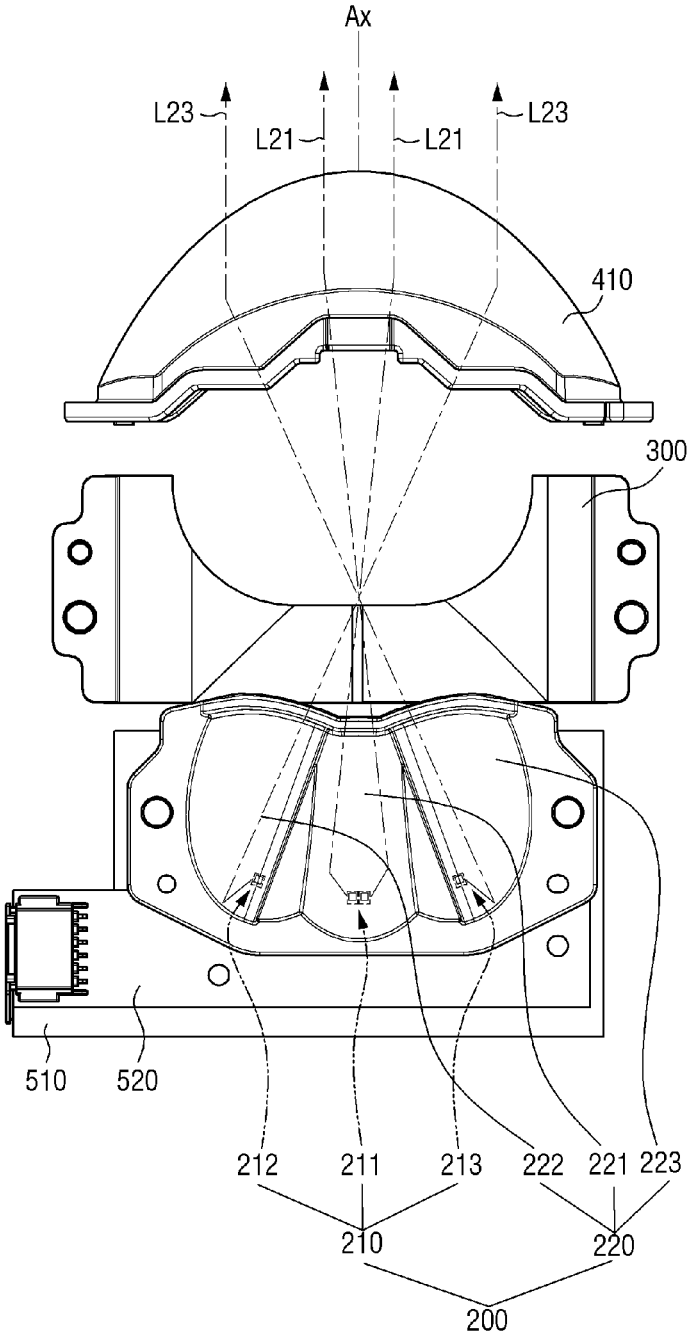
FIG. 15 is a schematic view illustrating an optical path of a second lamp unit according to an exemplary embodiment of the present invention.
Figure 16:
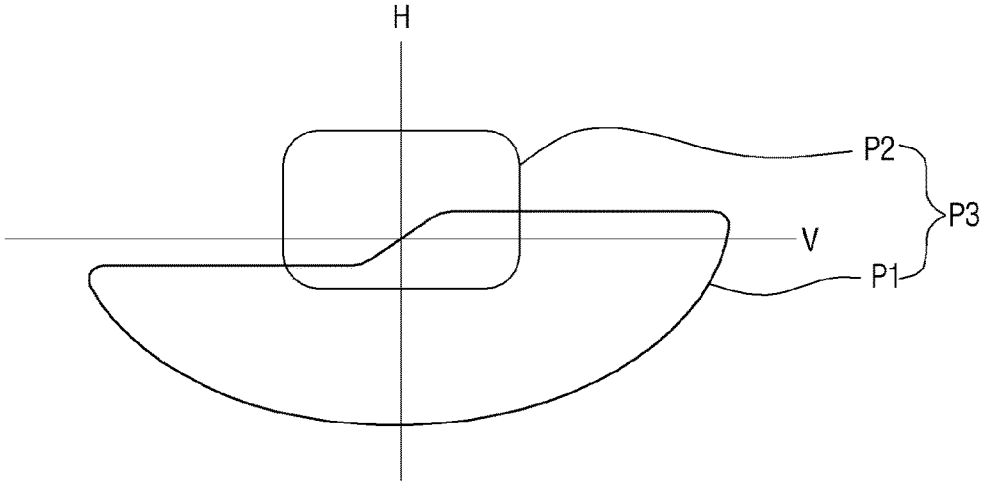
FIG. 16 is a schematic view illustrating a high beam pattern formed by the first lamp unit and the second lamp unit according to the exemplary embodiment of the present invention.

FIG. 15 is a schematic view illustrating an optical path of a second lamp unit according to an exemplary embodiment of the present invention, and FIG. 16 is a schematic view illustrating a high beam pattern formed by the first lamp unit and the second lamp unit according to the exemplary embodiment of the present invention. Referring to FIGS. 15 and 16, in the second lamp unit 200, the light L21 generated from the central light source 211 may be reflected by the central reflector 221, and the light L22 and L23 generated from the side light sources 212 and 213 may be reflected by the plurality of side reflectors 222 and 223, thereby making it possible to form a long-distance visual field pattern P2 for securing a long-distance visual field, and to form the high beam pattern P3 with the low beam pattern P1 formed by the lamp unit 100.

Referring to FIGS. 1 to 5 again, the shield unit 300 according to the exemplary embodiment of the present invention may be disposed in front of the first lamp unit 100 and the second lamp unit 200 may be configured to shield a part of light generated from the first lamp unit 100 to form the cut-off line of the low beam pattern. Both sides may be formed to have different heights based on a line parallel to the optical axis Ax of the lens unit 400 in accordance with the shape of the cut-off line. In addition, the shield unit 300 may have a reflective surface formed on the surface on which the light is shielded, and the reflective surface of the shield unit 300 reflects the shielded light to the lens unit 400 again to improve the light utilization efficiency.

The front end of the shield unit 300 may have a thickness as thin as possible to prevent an unnecessary blind zone from being formed between the beam patterns formed by the first lamp unit 100 and the second lamp unit 200, respectively. Accordingly, the front central part of the shield unit 300 may be configured to be formed and coupled by a different article machined to have a relatively thin thickness because when the entire shield unit 300 is formed to have a thin thickness, there is a high possibility that rigidity is decreased and the shield unit 300 is deformed.

The lens unit 400 may be disposed in front of the shield unit 300 and emit light generated from at least one of the first lamp unit 100 and the second lamp unit 200 to form a predetermined beam pattern in front of the vehicle. Various types of lenses may be used in accordance with the required lens characteristics. As an example, an aspherical surface lens may be used as the lens 410 to attain various lens characteristics. The lens unit 400 may include a lens 410, and a lens holder 420 that supports the lens 410. In addition, the lens unit 400 may be disposed in front of the shield unit 300 to couple the lens holder 420 to the front of the heat radiation unit 600.

As described above, according to the lamp for vehicle 1 of the present invention, since the plurality of light sources 111, 112, and 113 of the first lamp unit 100 and the plurality of light sources 211, 212, and 213 of the second lamp unit 200 may be spaced apart from each other, sufficient heat radiation effect may be obtained even with relatively low cost. Thus, productivity may be improved.

While the present invention has been particularly illustrated and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

What is claimed is:

1. A lamp for vehicle, comprising:

at least one lamp unit;

a shield unit that shields a part of light generated from the at least one lamp unit;

a lens unit disposed in front of the shield unit; and a heat radiation unit on which the at least one lamp unit is mounted, wherein the at least one lamp unit includes a first lamp unit and a second lamp unit disposed on an upper side and a lower side based on an optical axis of the lens unit, respectively, wherein the first lamp unit includes:

a first light source section including a plurality of light sources spaced apart from each other in a predetermined direction; and a first reflection section including a plurality of reflectors configured to reflect light generated from each of the plurality of light sources in a forward direction, wherein the second lamp unit includes:

a second light source section including a plurality of light sources spaced apart from each other in a predetermined direction; and a second reflection section including a plurality of reflectors configured to reflect light generated from each of the plurality of light sources in the forward direction, wherein each of the first light source section and the second light source section includes a central light source; and a plurality of side light sources spaced apart from each other on both sides of the central light source, wherein any one of the central light source of the first lamp unit and the central light source of the second lamp unit is disposed in front of the other, and wherein any one of the plurality of side light sources of the first lamp unit and the plurality of side light sources of the second lamp unit is disposed in front of the other.

2. The lamp for vehicle of claim 1, wherein the plurality of light sources of the first light source section and the second light source section are spaced apart from each other in a lateral direction.

3. The lamp for vehicle of claim 1, wherein each of the plurality of side light sources of the first light source section includes a same number of light-emitting elements.

4. The lamp for vehicle of claim 1, wherein each of the plurality of side light sources of the second light source section includes a same number of light-emitting elements.

5. The lamp for vehicle of claim 1, wherein any one of the central light source and the plurality of side light sources is disposed in front of the other.

6. The lamp for vehicle of claim 1, wherein the first lamp unit is turned on when forming a low beam pattern, and the second lamp unit is turned on together with the first lamp unit when forming a high beam pattern.

7. The lamp for vehicle of claim 1, wherein any one of the first light source section and the second light source section is disposed in front of the other.

8. The lamp for vehicle of claim 1, wherein the number of light-emitting elements included in the central light source of the first lamp unit is different from the number of light-emitting elements included in the central light source of the second lamp unit.

9. The lamp for vehicle of claim 1, wherein the number of light-emitting elements included in the plurality of side light sources of the first lamp unit is different from the number of light-emitting elements included in the plurality of side light sources of the second lamp unit.

* * * * *